US005744900A

United States Patent [19]

Labant

[11] Patent Number: 5,744,900

[45] Date of Patent: Apr. 28, 1998

[54] PINK LAMP AND COATING THEREFOR

[75] Inventor: Cynthia J. Labant, St. Marys, Pa.

[73] Assignee: Osram Sylvania Inc., Danvers, Mass.

[21] Appl. No.: 733,412

[22] Filed: Oct. 4, 1996

[51] Int. Cl.[6] ..... H01J 5/16; H01J 61/40

[52] U.S. Cl. ..... 313/112; 313/110; 313/116

[58] Field of Search ..... 313/112, 110, 313/116, 635; 106/454, 446, 457, 459

[56] References Cited

U.S. PATENT DOCUMENTS 4,395,653 7/1983 Graff ..... 313/112

4,441,046 4/1984 James ..... 313/212

5,252,887 10/1993 Reisman ..... 313/112

5,444,329 8/1995 Matsuda et al. ..... 313/112

*Primary Examiner*—George M. Dombroske

*Assistant Examiner*—Max H. Noori

*Attorney, Agent, or Firm*—William H. McNeill

[57] ABSTRACT

An electric lamp which exhibits a pink color when energized and which comprises a vitreous, light transmissive envelope and enclosing a filament within and a coating on a surface of said envelope. The coating comprises about 42.5 w% calcined kaolin clay; about 42.5 w% synthetic precipitated silica; about 5 w% titanium dioxide; about 7 w% of chrome tin pink sphene; and about 3 w% red iron oxide.

7 Claims, 1 Drawing Sheet

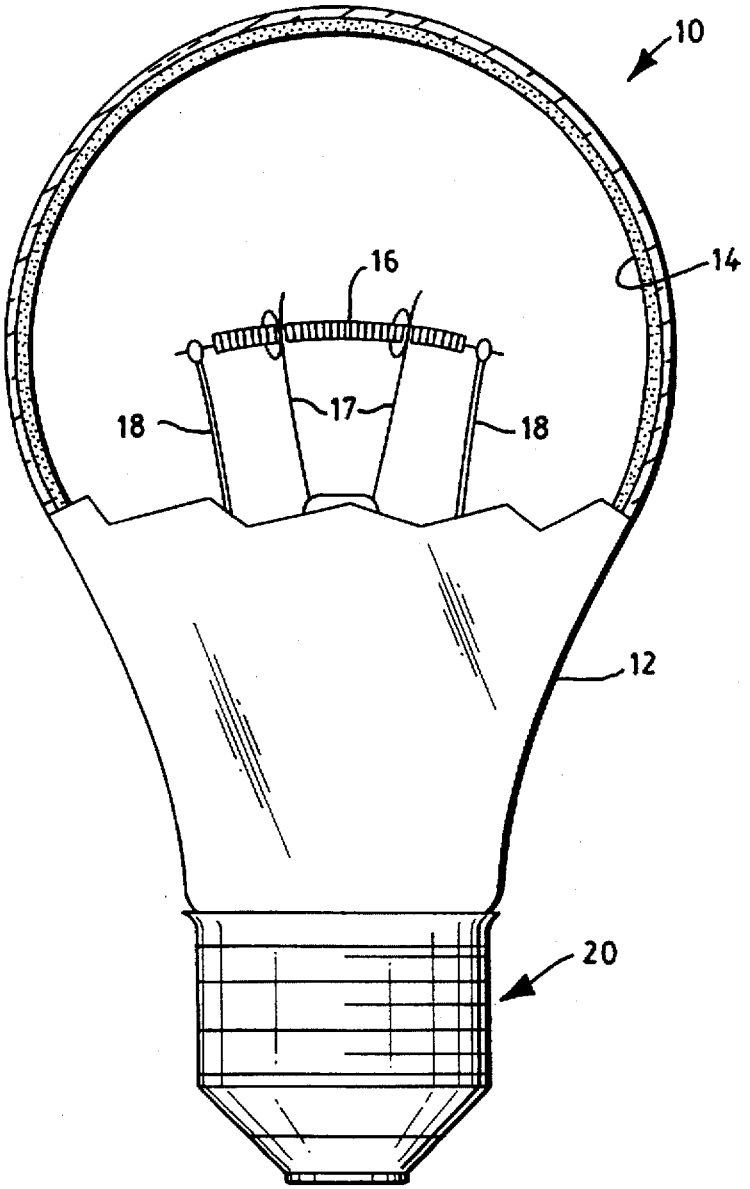
10
14
16
17
18
18
12
20

PINK LAMP AND COATING THEREFOR

TECHNICAL FIELD

This invention relates to a pink lamp which utilizes compounds other than those based on cadmium and selenium and thus is environmentally safe, both during its fabrication and its disposal. More particularly, the invention relates to a pink decorative lamp comprising a vitreous light transmissive envelope enclosing an electric light source. The envelope has thereon a coating comprising a chrome tin pink inorganic pigment and a red iron oxide pigment. The coating does not contain cadmium or selenium.

BACKGROUND ART

Pink decorative lamps have been made and used for some years and have included pigments such as cadmium selenide and cadmium sulfide in the lamp coating for emitting a pink color. Cadmium and selenium are relatively hazardous material to work with and lead also to problems of disposal. The coatings are usually applied electrostatically to the inner surface of the lamp envelope, which results in some airborne contamination.

Recently, a pink coating has been developed employing a large amount (i.e., from about 15 w% to over 40 w%) of a chrome tin pink sphene inorganic pigment (see U.S. Pat. No. 5,252,887, for an example of the latter amount). This pigment also includes amounts of calcium and silicon and provides a pink color when lit and when unlit. The pigment has the general formula $CaO:SnO:SiO_2:Cr_2O_3$. While this coating eliminated the cadmium and selenium, it suffered from coating defects in that it was very susceptible to agglomerates, pinholes and stratification.

DISCLOSURE OF INVENTION

It is, therefore, an object of the invention to obviate the disadvantages of the prior art.

It is another object of the invention to enhance the appearance and producibility of pink lamps.

Yet another object of the invention is the provisions of such a lamp which does not utilize cadmium and selenium.

Still another object of the invention is the provision of a coating material that does not suffer from the disadvantages of the prior art.

These objects are accomplished, in one aspect of the invention, by an electric lamp which exhibits a pink color when energized and which comprises a light transmissive envelope enclosing an electric light source and having a pink coating on a surface of the envelope, the coating containing a chrome tin pink inorganic pigment and a red iron oxide pigment. The coating is free of cadmium and selenium.

In another aspect of the invention, the objects are accomplished by a composition for providing a pink color when applied to an electric lamp. The composition comprises, in weight percent (w%) about 42.5 w% calcined kaolin clay; about 42.5 w% synthetic precipitated silica; about 5 w% titanium dioxide; about 7 w% of chrome tin pink sphene; and about 3 w% red iron oxide.

This composition provides a free-flowing, non-agglomerating medium that is easy to apply and that is substantially pinhole free.

BRIEF DESCRIPTION OF THE DRAWINGS

The single FIGURE illustrates a typical incandescent lamp having the composition of the invention on the inside surface.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawing with greater particularity, there is shown an A-line lamp 10 having a light transmissive glass envelope 12 enclosing a filament 16. The filament 16 is electrically connected to and supported by lead-ins 18 which extend through the seal of the lamp (not shown) and are attached to the metal screw base 20, as is known. If necessary, additional support for the filament can be provided by support wires 17.

The interior surface of envelope 12 is coated with a powder coating 14 which can be applied electrostatically, as is well known.

In a preferred form of the invention the powder comprises, in weight percent, 42.5% calcined kaolin clay (Burgess #50); 42.5% synthetic precipitated silica (PPG Lovel 27); 5% titanium oxide Rutile (SCM Chemicals 0535 $TiO_2$); 7% chrome tin pink sphene (Ferro Maroon C-896); and 3% red iron inorganic oxide pigment (Bayferrox 110M).

The material has an average bulk density of 4.5–5.5 lbs./ft$^3$, an average water content of 2.5–3.0%, and an average particle size of 1.25 microns, and is free-flowing and substantially without agglomerates. The coating it provides is substantially free of pinholes and stratification.

While there have been shown and described what are at present considered the preferred embodiments of the invention, it will be apparent to those skilled in the art that various changes and modifications can be made herein without departing from the scope of the invention as defined by the appended claims.

What is claimed is:

1. An electric lamp which exhibits a pink color when energized and which comprises a light transmissive envelope enclosing an electric light source and having a pink coating on a surface of said envelope, said coating containing a chrome tin pink inorganic pigment and a red iron oxide pigment, said coating being free of cadmium and selenium.

2. The electric lamp of claim 1 wherein said chrome tin pink inorganic pigment comprises about 7 w% of said coating; said red iron oxide pigment comprises about 3 w% of said coating; and the balance of said coating includes color modifying and adhesion promoting ingredients.

3. The lamp of claim 2 having a pink color when unlit.

4. An electric lamp which exhibits a pink color when energized and which comprises a vitreous, light transmissive envelope and enclosing a filament within and a coating on a surface of said envelope, said coating comprising a chrome tin pink inorganic pigment and a red iron oxide pigment.

5. The electric lamp of claim 4 wherein said chrome tin pink inorganic pigment comprises about 7 w% of said coating; said red iron oxide pigment comprises about 3 w% of said coating; and the balance of said coating includes color modifying and adhesion promoting ingredients.

6. A composition comprising, in weight percent, about 42.5 w% calcined kaolin clay; about 42.5 w% synthetic precipitated silica; about 5 w% titanium dioxide; about 7 w% of chrome tin pink sphene; and about 3 w% red iron oxide.

7. An electric lamp which exhibits a pink color when energized and which comprises a vitreous, light transmissive envelope and enclosing a filament within and a coating on a surface of said envelope, said coating comprising about 42.5 w% calcined kaolin clay; about 42.5 w% synthetic precipitated silica; about 5 w% titanium dioxide; about 7 w% of chrome tin pink sphene; and about 3 w% red iron oxide.

* * * * *